US007073888B2

(12) United States Patent
Katakura

(10) Patent No.: US 7,073,888 B2
(45) Date of Patent: Jul. 11, 2006

(54) INK JET RECORDING DEVICE, AND RECORDING HEAD

(75) Inventor: Takahiro Katakura, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/472,937

(22) PCT Filed: Mar. 28, 2002

(86) PCT No.: PCT/JP02/03067

§ 371 (c)(1),
(2), (4) Date: Sep. 26, 2003

(87) PCT Pub. No.: WO02/078957

PCT Pub. Date: Oct. 10, 2002

(65) Prior Publication Data

US 2004/0113976 A1 Jun. 17, 2004

(30) Foreign Application Priority Data

Mar. 28, 2001 (JP) ..... 2001-092734

(51) Int. Cl.
*B41J 2/145* (2006.01)

(52) U.S. Cl. ..... 347/40; 347/16

(58) Field of Classification Search ..... 347/40, 347/41, 16, 43, 9, 12
See application file for complete search history.

(56) References Cited

U.S. PATENT DOCUMENTS 4,803,500 A * 2/1989 Milbrandt ..... 347/49
5,683,188 A 11/1997 Miyazaki et al.
6,030,065 A 2/2000 Fukuhata
6,325,489 B1 * 12/2001 Endo ..... 347/43

FOREIGN PATENT DOCUMENTS

| | | | |
|---|---|---|---|
| EP | 0 724 962 | A1 | 8/1996 |
| EP | 0 925 950 | A2 | 6/1999 |
| EP | 955174 | A2 * | 11/1999 |
| JP | 8-216416 | | 8/1996 |
| JP | 08-267832 | A | 10/1996 |
| JP | 9-104107 | | 4/1997 |
| JP | 10-119316 | A | 5/1998 |
| JP | 11-179942 | A | 7/1999 |
| JP | 2000-225719 | A | 8/2000 |

* cited by examiner

*Primary Examiner*—Thinh Nguyen
(74) *Attorney, Agent, or Firm*—Sughrue Mion, PLLC

(57) ABSTRACT

An ink jet recording apparatus includes a color ink recording head 6 having nozzle openings Nc arranged at pitch Pc in a paper feed direction as N×P (N is an integer of four or more being not a prime number) when pitch of dots required for print is P, and a black ink recording head 5 having m nozzle openings Nb1 (m is a divisor of two or more, of N) arranged at pitch Pb1 in the paper feed direction as P and nozzle openings Nb2 arranged at pitch Pb2 in the paper feed direction as {N−(m−1)}P. Paper feed is executed in units of mP and image data is printed by the color ink recording head 6 and text data is printed by the black ink recording head 5 at the same time. Accordingly, the text data and the image data existing in the same path can be printed at their respective optimum resolutions.

5 Claims, 12 Drawing Sheets

FIG. 11

| | Nm | FIRST RECORD HEAD SECTION | SECOND RECORD HEAD SECTION | NOZZLE OPENING PITCH | PAPER FEED UNIT |
|---|---|---|---|---|---|
| I | N = 4<br>m = 2 | Pc<br>Pb1<br>Pb3 | | Pc = 4P<br>Pb1 = P<br>Pb3 = 3P | 2P |
| II | N = 6<br>m = 2 | Pc<br>Pb1<br>Pb3 | | Pc = 6P<br>Pb1 = P<br>Pb3 = 5P | 2P |
| III | N = 6<br>m = 3 | Pc<br>Pb1<br>Pb3 | | Pc = 6P<br>Pb1 = P<br>Pb3 = 4P | 3P |
| IV | N = 8<br>m = 2 | Pc<br>Pb1<br>Pb3 | | Pc = 8P<br>Pb1 = P<br>Pb3 = 7P | 2P |
| V | N = 8<br>m = 4 | Pc<br>Pb1<br>Pb3 | | Pc = 8P<br>Pb1 = P<br>Pb3 = 5P | 4P |

INK JET RECORDING DEVICE, AND RECORDING HEAD

TECHNICAL FIELD

This invention relates to an art of printing text data and image data on the same sheet of record paper at their respective optimum resolutions.

BACKGROUND ART

For example, an ink jet color recording apparatus includes a black ink recording head having nozzle openings arranged at a higher density than those of a color ink recording head cooperating with the black ink recording head, because of performing text print in black ink with the print quality largely affected by the dot density and color print largely affected by arrangement of a plurality of color inks rather than the dot density.

Thus, to print text data and color image data on the same sheet of record paper, for example, as shown in FIG. 12, when text data B and image data C exist in the same print path as in an area A, if the record paper is fed corresponding to the dot density of the black ink recording head, ink droplets ejected from the color ink recording head with low dot density are not printed at predetermined positions.

Consequently, if an attempt is made to print the text data in the area A with high print quality, the image data must be printed at the same unnecessarily high resolution as the text data, and there is a problem of lowering the print speed.

The invention is embodied considering such problems and it is an object of the invention to provide an ink jet recording apparatus that can print text data and image data existing in the same path at optimum resolution.

It is another object of the invention to provide recording heads for high-resolution print suitable for the ink jet recording apparatus.

DISCLOSURE OF THE INVENTION

An ink jet recording apparatus of the invention includes a first recording head section having nozzle openings arranged at pitch Pc in a paper feed direction as N×P (N is an integer of four or more being not a prime number) when pitch of dots required for print is P; and a second recording head section having m nozzle openings (m is a divisor of two or more, of N) arranged at pitch Pb1 in the paper feed direction as P and nozzle openings arranged at pitch Pb2 in the paper feed direction as $\{N-(m-1)\}P$, wherein paper feed is executed in units of mP and image data is printed by the first recording head section and text data is printed by the second recording head section at the same time.

By executing paper feed suitable for the first recording head section, for example, a color ink recording head, dots of closely arranged nozzle openings of the second recording head section, for example, a black ink recording head are formed so as to bridge a gap at a higher resolution than that of the color ink recording head. Accordingly, text data at high dot density can be printed at the same time independently of the print operation of image data at low dot density.

BRIEF DESCRIPTION OF THE DRAWINGS

FIG. 11 is a drawing to show the record modes of the invention in generalized form.

BEST MODE FOR CARRYING OUT THE INVENTION

Figure 1:
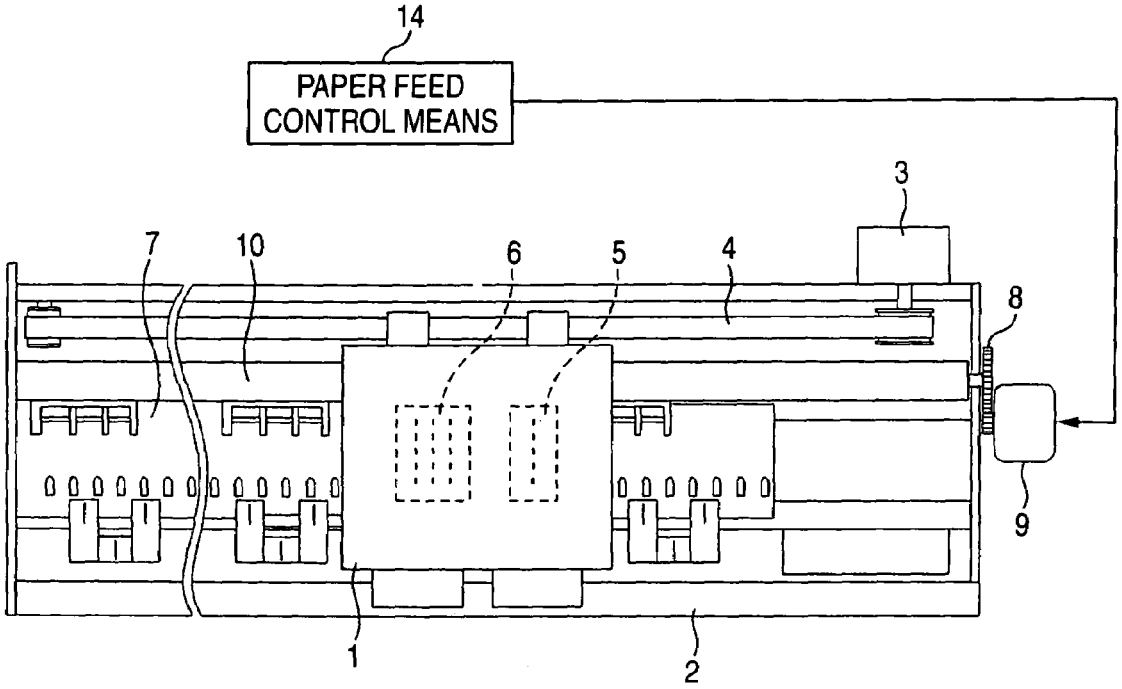
FIG. 1 is a configuration drawing to show one embodiment of an ink jet recording apparatus of the invention.

FIG. 1 shows one embodiment of the invention. A carriage 1 can be reciprocated in the width direction of a record medium by a timing belt 4 connected to a carriage drive motor 3 as it is guided by guide means 2, and a black ink recording head 5 and a color ink recording head 6 are mounted on the carriage 1 so as to be opposed to a platen 7.

A paper feed roller 10 driven by a paper feed motor 9 via a wheelwork 8 is placed in an area in the proximity of the upstream platen 7 in the paper feed direction.

Control means 14 causes the paper feed motor 9 to execute paper feed at half units of paper feed pitch Pc required for print with the color ink recording head 6, as described later.

Figure 2:
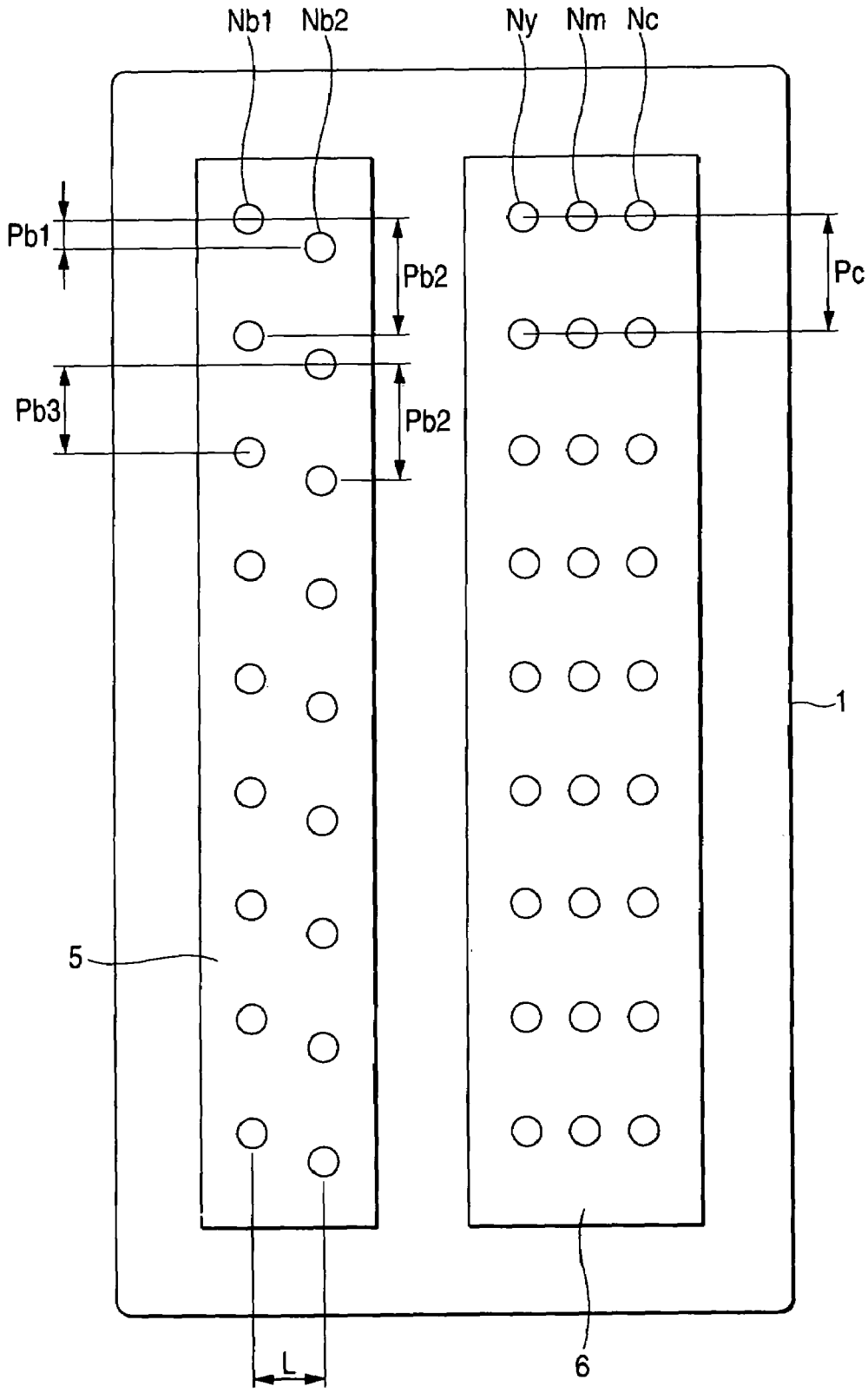
FIG. 2 is a drawing to show one embodiment of recording heads used with the recording apparatus as arrangement of nozzle openings.

FIG. 2 shows one embodiment of the arrangements of nozzle openings of the black ink recording head 5 and the color ink recording head 6 described above. In the embodiment, the black ink recording head 5 includes two rows of nozzle openings Nb1 and Nb2 in the embodiment, and each pitch Pb2 of the nozzle openings Nb1, Nb2 is set to the same as arrangement pitch Pc of nozzle openings Nc, Nm, Ny of the color ink recording head 6, in the embodiment, 180 dpi.

In addition, the nozzle openings Nb1, Nb2 are placed leaning to one side so that the nozzle openings adjacent in the paper feed direction become far and close in each other. That is, the nozzle opening pitch Pb1 is a pitch suitable for text print, for example, 720 dpi and the largely apart pitch Pb3 is pitch Pb2−Pb1 smaller than the nozzle opening pitch Pb2 of each row by the pitch Pb1, in the embodiment, 240 dpi.

On the other hand, the color ink recording head 6 includes at least three rows of nozzle openings Nc, Nm, and Ny arranged at the pitch Pc suitable for color print so as to be able to eject three types of ink separately.

Figure 3:
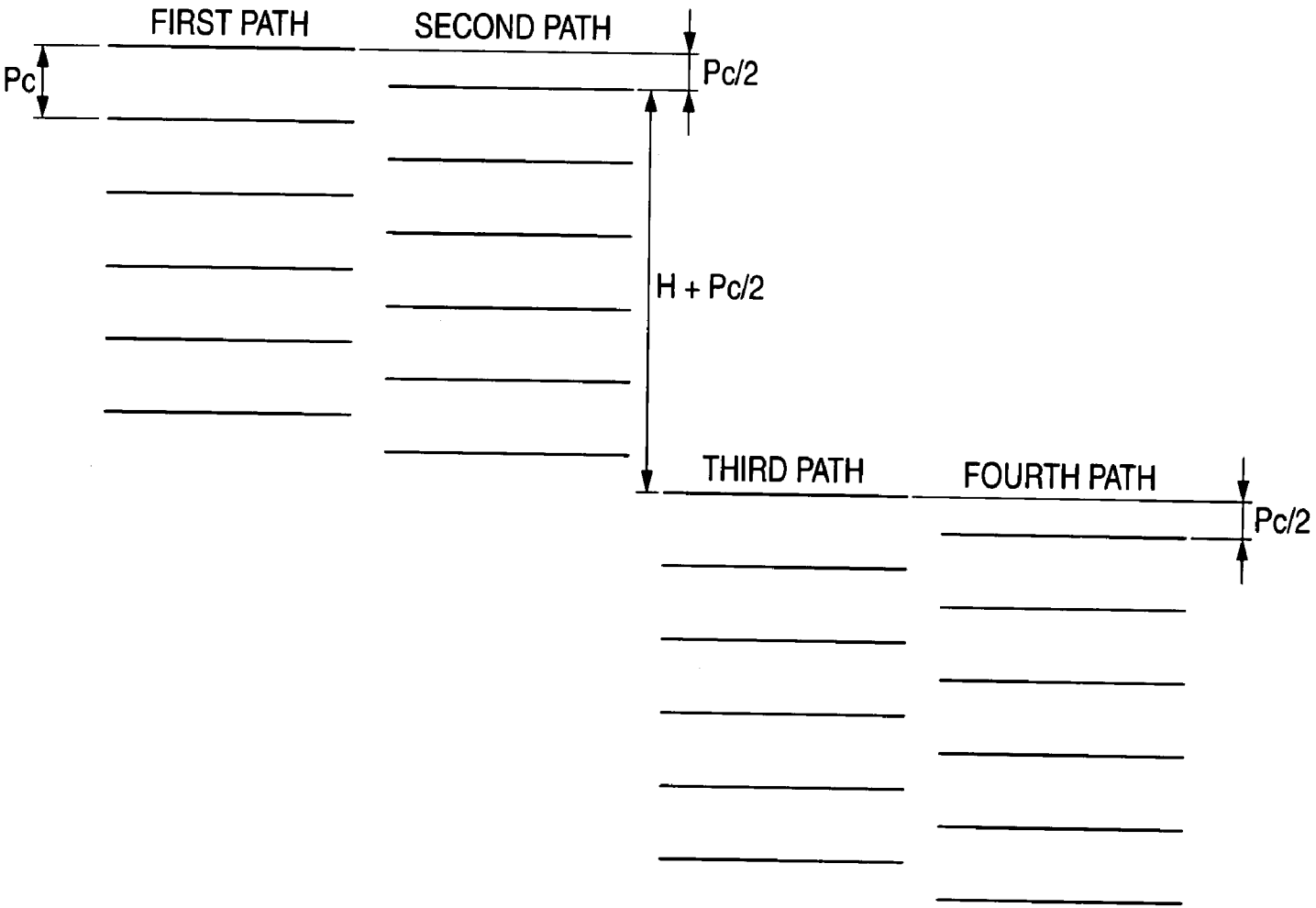
FIG. 3 is a drawing to show dot formation by a color ink recording head of the recording apparatus.
Figure 4:
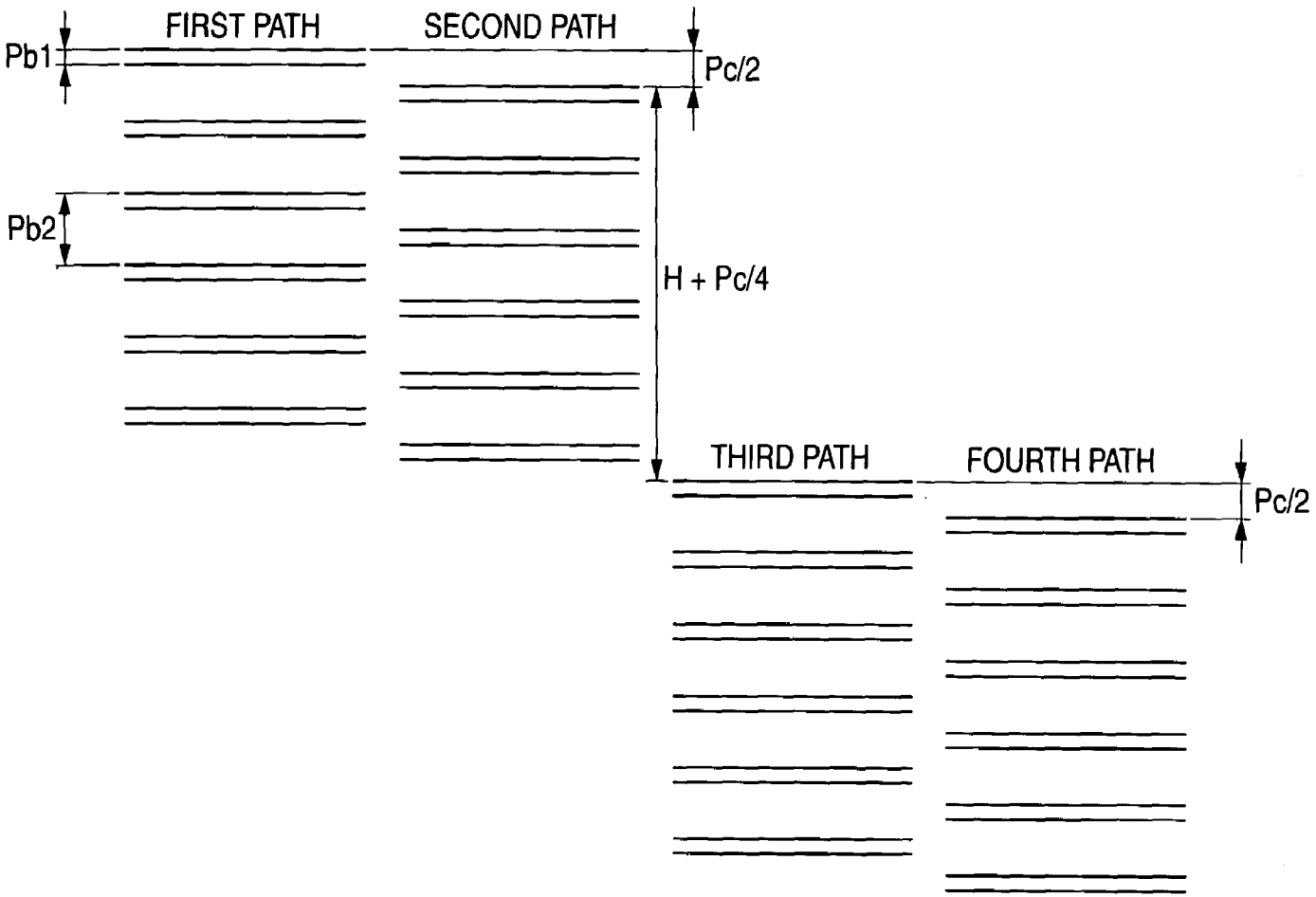
FIG. 4 is a drawing to show data formation at high-quality print time of text data by the recording apparatus.

In the embodiment, to print print data with text data and image data mixed in the embodiment, when print in one path terminates, dots are printed at 180 dpi (Pc=1/180 inches) by the color ink recording head 6 as shown in FIG. 3, and dots are printed at 720 dpi (pitch Pb1=1/720 inches) and 240 dpi (pitch Pb2−Pb1=1/240 inches) by the black ink recording head 5 as shown in FIG. 4.

When paper feed is executed at half pitch of the nozzle opening arrangement pitch Pc of the color ink recording head 6, in the embodiment, 1/360 inches at the termination stage of the print in the first path, dots are printed by the color ink recording head 6 between the lines printed in the first path and consequently, it is made possible to print at a resolution of 360 dpi.

On the other hand, dots in the second path are formed by the black ink recording head 5 between the lines at loose pitch printed in the first path, as shown in FIG. 4. Accordingly, one-line print at the pitch Pb1 between nearby nozzle openings, namely, 720 dpi is completed.

Next, paper feed (H+Pc/4) is executed at print width H and the nozzle opening pitch Pc of the color ink recording head 6 divided by a number of divisions, in the embodiment, a quarter, and the above-described operation is repeated, whereby printing image data in color ink is not performed at unnecessarily high resolution and printed matter with a mixture of text data with high print quality and a color image can be provided in print time equal to the print time of only text data.

Also in such a print method, ink droplets different in ink amount are ejected from the recording heads, whereby gradation can be modulated, needless to say.

That is, ink droplets fitted for the 360-dpi resolution are selected from among several steps in the range of 39×10 (minus ninth power) ng at the maximum to 2×10 (minus ninth power) ng at the minimum, for example, whereby ink droplets different in ink amount can be ejected from the color ink recording head 6 for printing image data with smooth gradation.

On the other hand, only ink droplets of the ink amount most fitted for the 720-dpi resolution, for example, 13×10 (minus ninth power) ng are ejected from the black ink recording head 5 at frequency twice the drive frequency of the color ink recording head 6, whereby dots can be formed with high resolution not only in the paper feed direction, but also in the paper width direction, making possible text print with high print quality.

By the way, when a distance L between the two rows of the nozzle openings Nb1 and Nb2 formed in the black ink recording head is extremely small, spreading of ink on a record paper may occur depending on a kind of record papers, incurring degradation of the print quality.

In such a case, if the distance L is extended to such an extent that spreading of ink does not occur or if the print timing is adjusted so as to form a dot through another adjacent nozzle opening after the expiration of a predetermined time after forming a dot through one of adjacent nozzle openings, spreading of ink can be prevented as much as possible.

Figure 5:
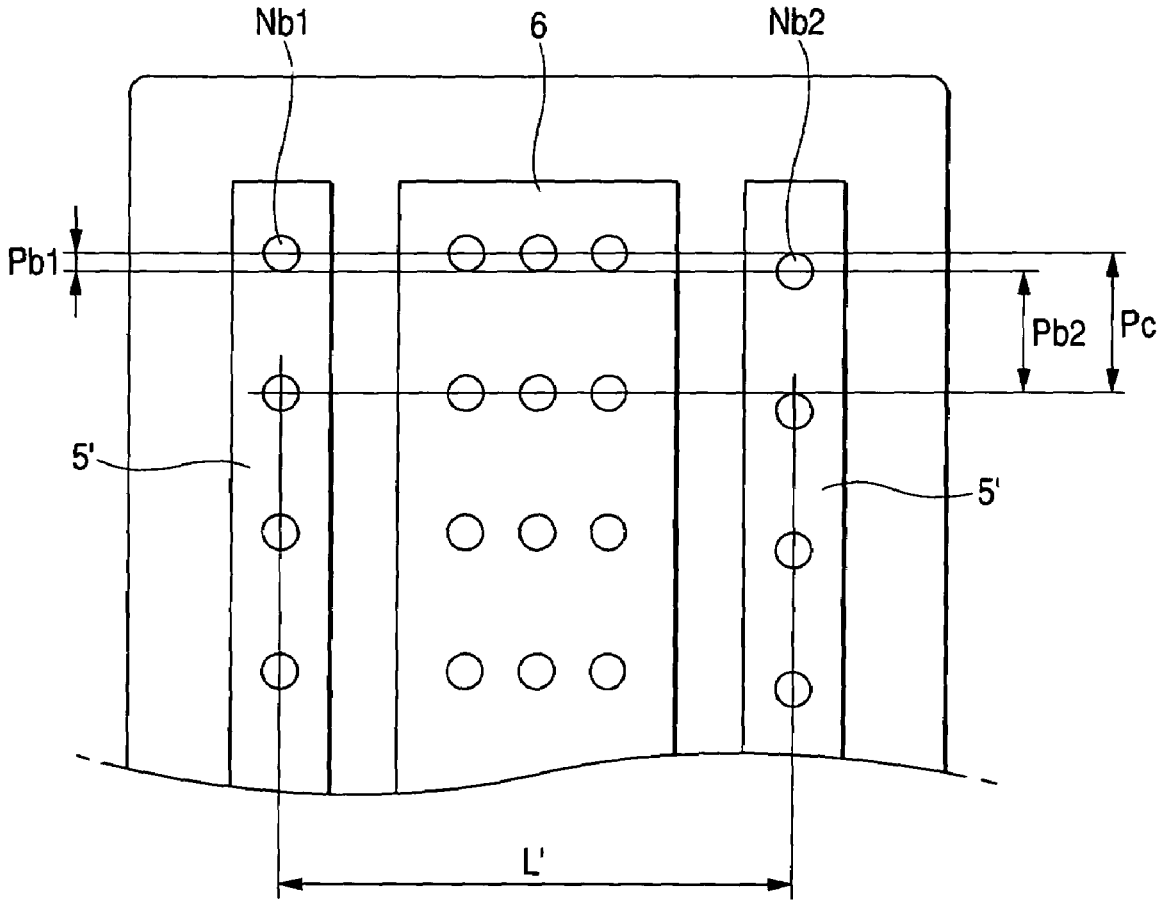
FIG. 5 is a drawing to show another embodiment of recording heads as arrangement of nozzle openings.

Further, as shown in FIG. 5, if the black ink recording head 5 is divided into two recording heads 5' and 5' and the recording head 6 is sandwiched between the two rows of the nozzle openings Nb1 and Nb2, thereby extending the distance between the nozzle openings Nb1 and Nb2 for ejecting black ink to L', spreading of ink can be prevented as much as possible without decreasing the print speed.

The embodiment has been described by taking the case where the resolution of the black ink recording head 5 is made twice that of color ink as an example, but it is also possible to make the resolution of the black ink recording head 5 three times or more that of color ink.

Figure 6:
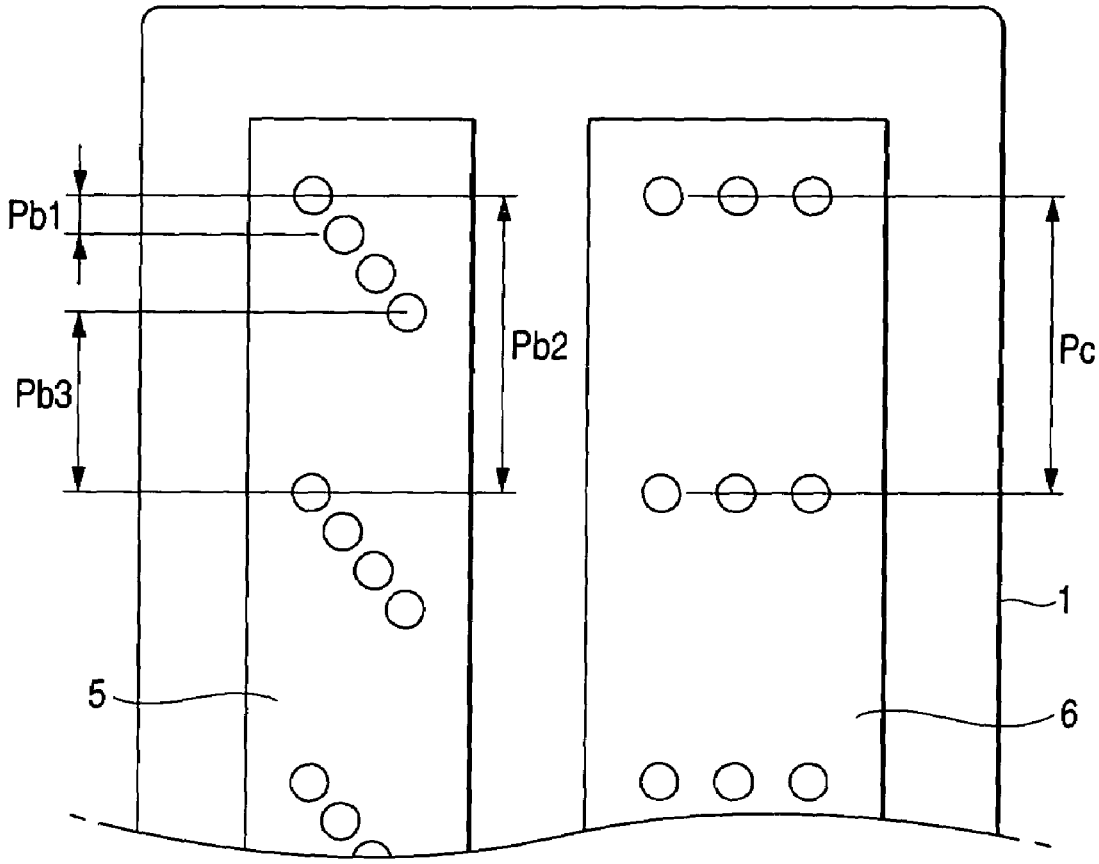
FIG. 6 is a drawing to show another embodiment of recording heads fitted for the recording apparatus as arrangement of nozzle openings.

That is, as shown in FIG. 6, nozzle openings may be formed by the number of divisions m (m is a divisor of two or more, of N and N is an integer of four or more being not a prime number), in this embodiment, for nozzle opening at pitch Pb1 id formed. The number of divisions divides the difference (Pc−Pb1) between the pitch Pc of the nozzle openings of the color ink recording head 6 and the arrangement pitch Pb1 of the nozzle openings between nozzle rows of the black ink recording head 5 so as to become any desired pitch, in the embodiment, at pitch pb1.

Figure 7:
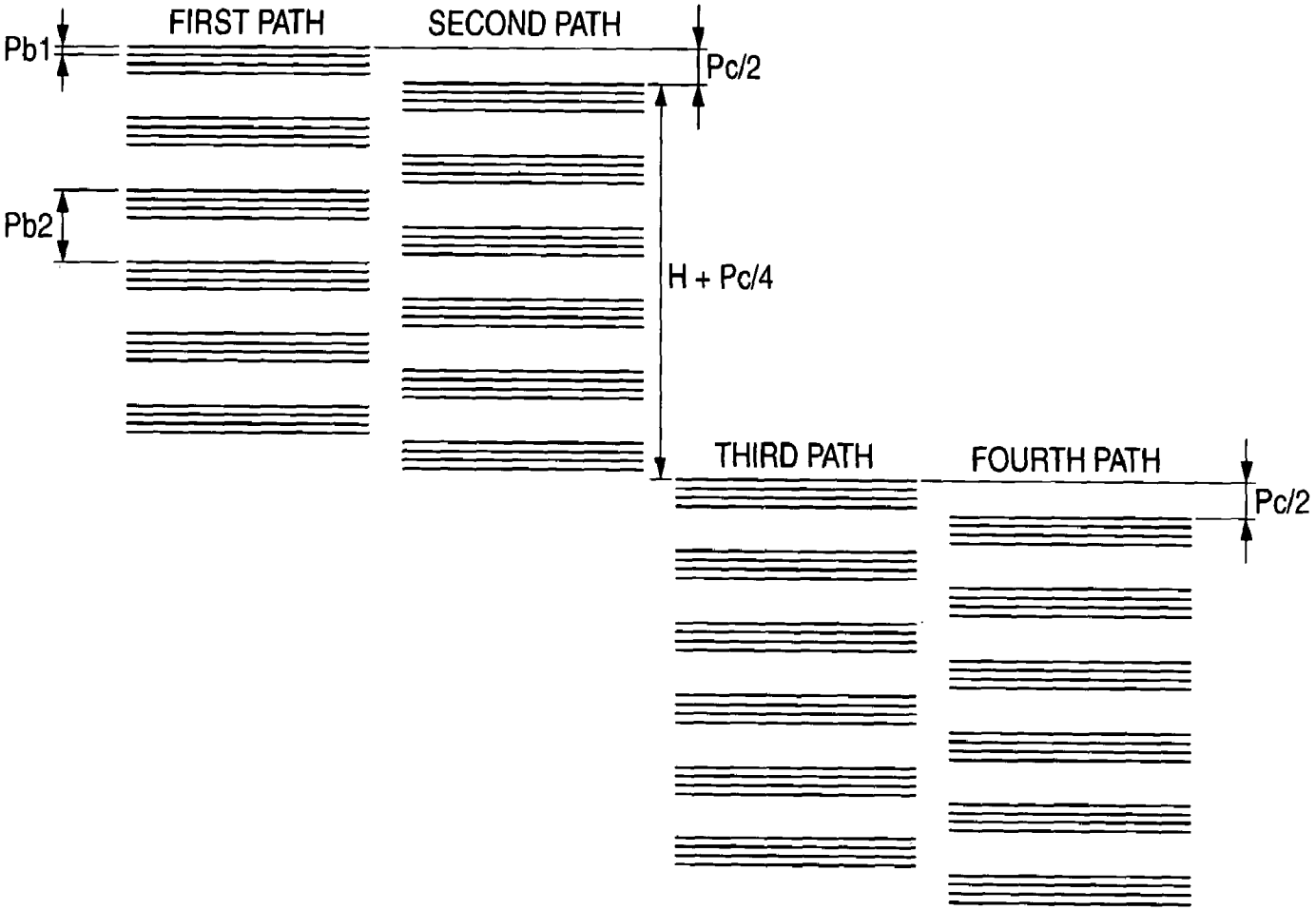
FIG. 7 is a drawing to show data formation at high-quality print time of text data by the recording heads.

Accordingly, as shown in FIG. 7, in the first path, four lines at the nozzle opening pitch Pb1 and line at half pitch of the nozzle opening pitch Pc of the color ink recording head 6 are mixed and formed. Next, paper feed is executed at the half pitch of the nozzle opening pitch Pc of the color ink recording head 6 and the second path is printed. Accordingly, one line can be printed at one-eighth pitch of the nozzle opening pitch Pc of the color ink recording head 6.

Then, as in the above-described embodiment, paper feed (H+Pc/8) that is at the print width H and one-eighth of the nozzle opening pitch Pc of the color ink recording head 6 is executed, and the above-described operation is repeated, whereby printing image data in color ink is not performed at unnecessarily high resolution and printed matter with a mixture of text data with high print quality and a color image can be provided in print time equal to the print time of only text data.

Figure 8:
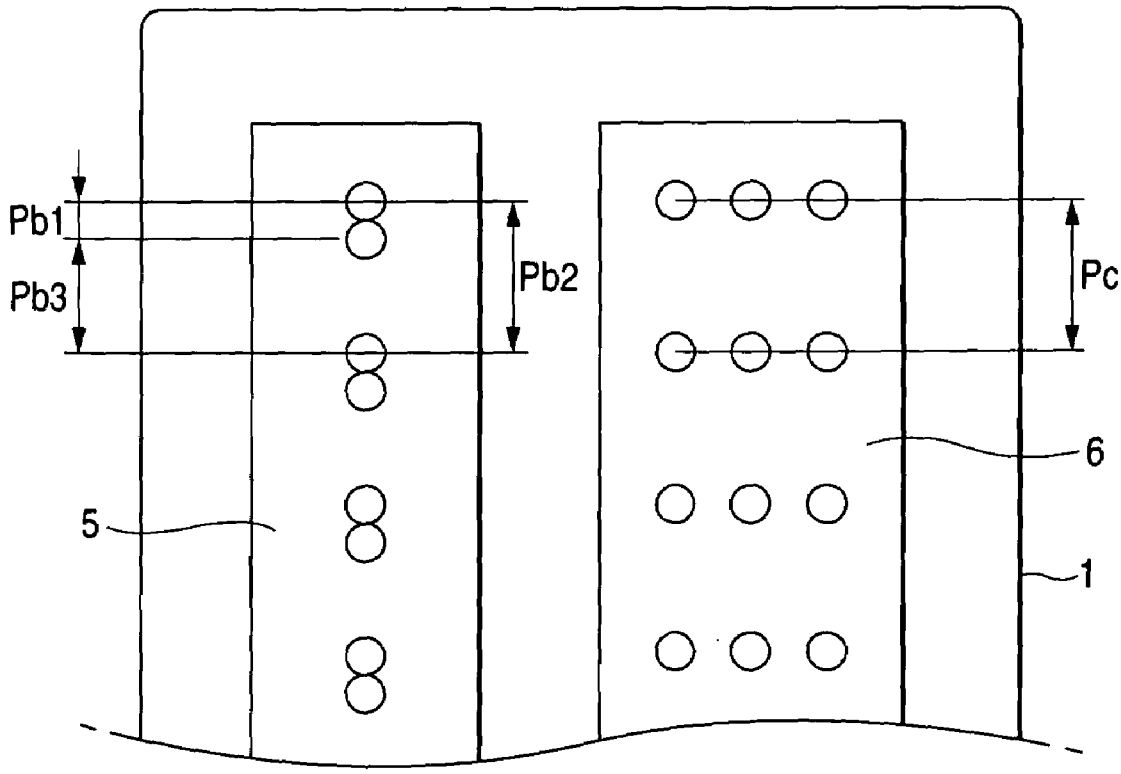
FIG. 8 is a drawing to show another embodiment of recording heads fitted for the recording apparatus as arrangement of nozzle openings.

In the embodiment described above, the nozzle openings arranged at small pitch are divided and formed in a plurality of rows, but can also be formed in one row as shown in FIG. 8.

In the embodiment described above, the nozzle opening pitch Pc of the color ink recording head 6 is bridged by performing twice the print operation, but can also be bridged in three or more print paths.

Figure 9:
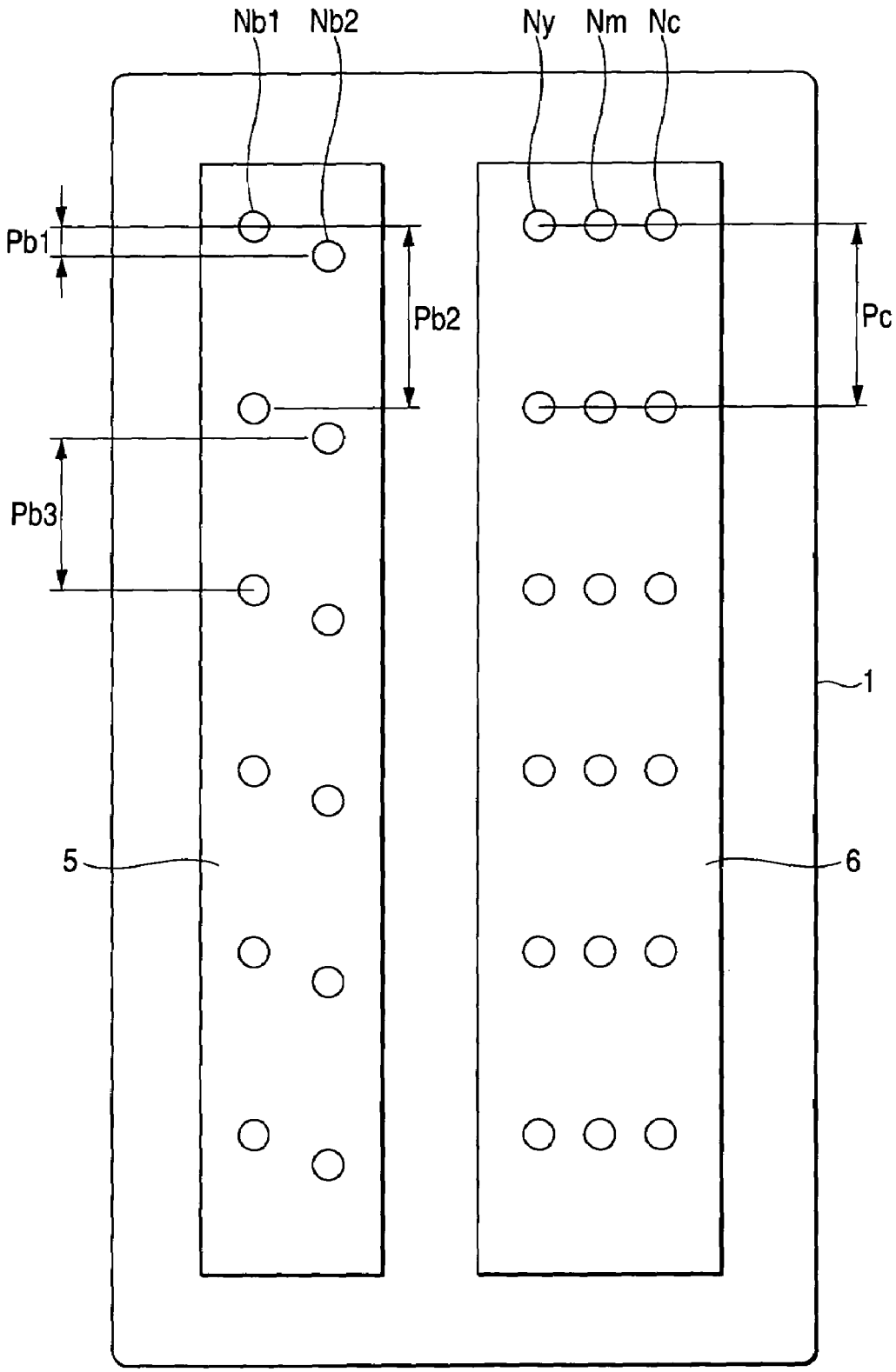
FIG. 9 is a drawing to show another embodiment of recording heads fitted for the recording apparatus as arrangement of nozzle openings.
Figure 10:
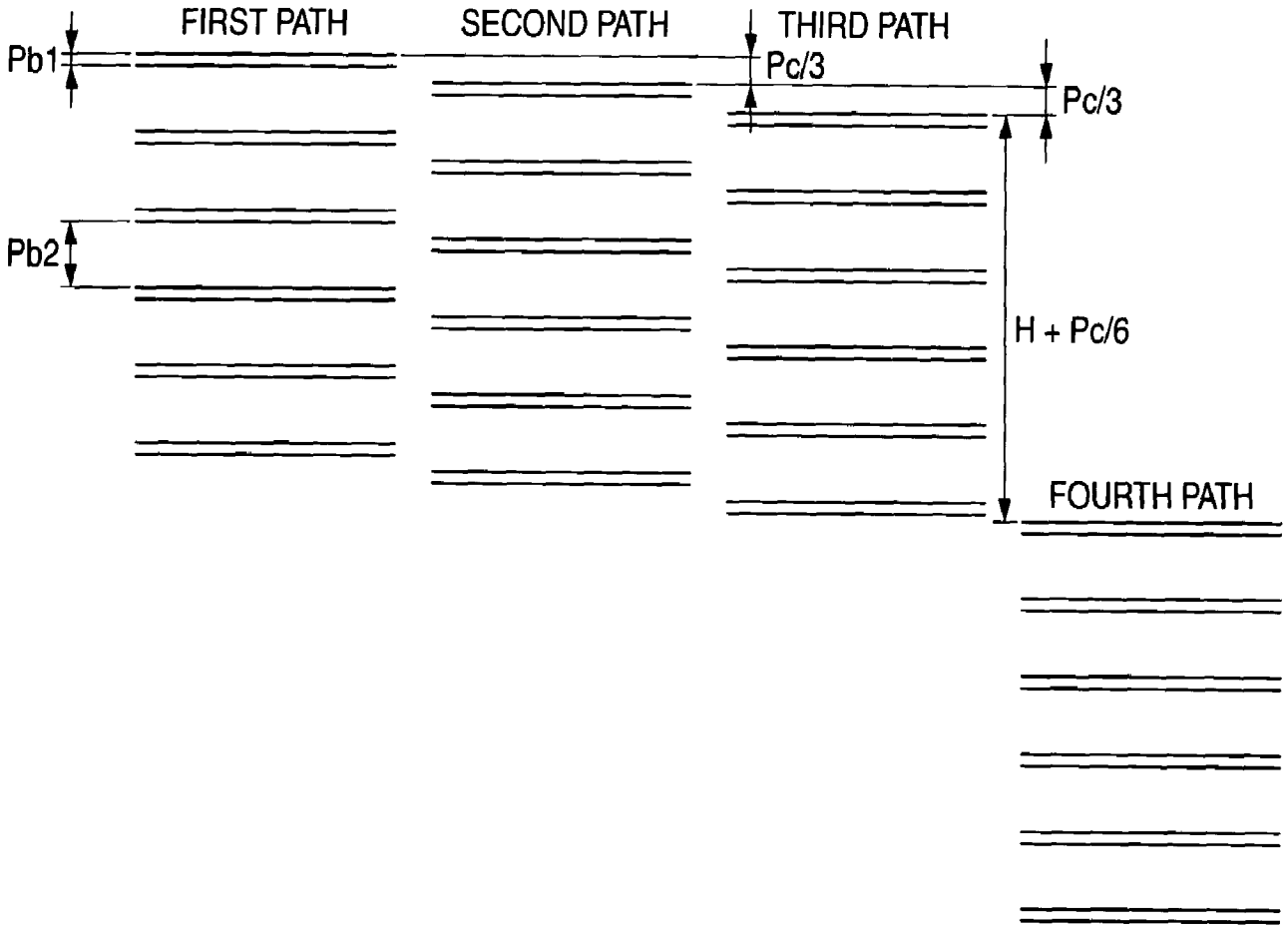
FIG. 10 is a drawing to show data formation at high-quality print time of text data by the recording heads.
Figure 12:
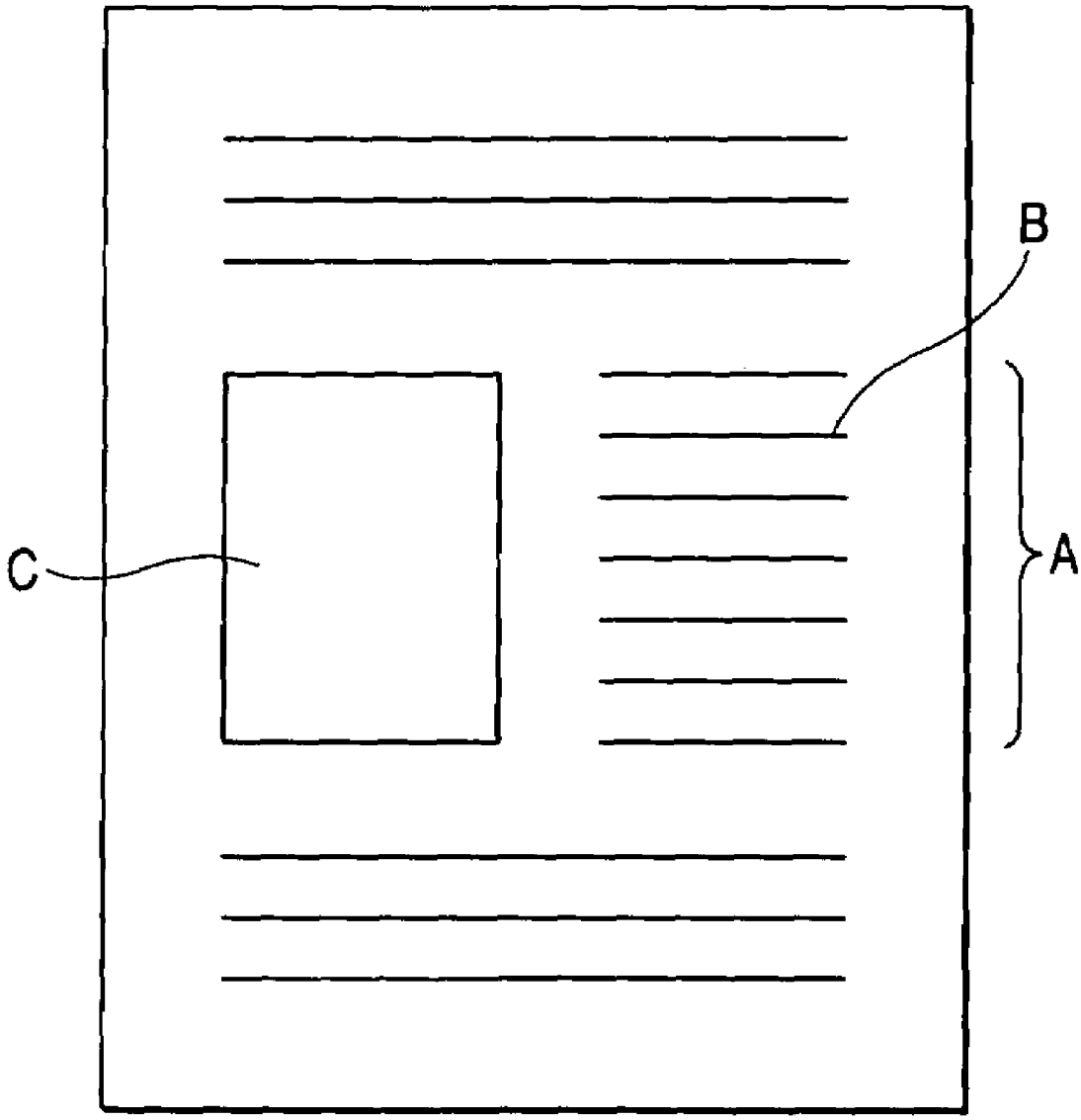
FIG. 12 is a drawing to show an example of printed matter comprising text data and image data mixed and printed on the same sheet of record paper.

That is, as shown in FIG. 9, the nozzle openings of the black ink recording head 5 are arranged at two types of pitches of Pb1=Pc/6 and Pb2=Pc (6−1)/6 relative to the nozzle opening pitch Pc of the color ink recording head 6 and as shown in FIG. 10, while paper feed is executed at Pc/3, the first path to the third path are printed so as to bridge the nozzle opening pitch Pc of the color ink recording head 6, and then paper feed is executed at (H+Pc/6) and the above-described operation is repeated, whereby printing image data in color ink is not performed at unnecessarily high resolution and print can be accomplished with high print quality.

The invention described above is generalized with respect to the relationship N, m of the arrangement pitches of the nozzle openings Nc, Nb1 and Nb2 of the color ink recording head 6 (first recording head section) and the black ink recording head 5 (second recording head section), the arrangement pitches Pc, Pb1 and Pb3, and paper feed where pitch of dots required for print is P, as shown in FIG. 11.

That is, the color ink recording head 6 has the nozzle openings Nc arranged at a pitch Pc of NP (N is an integer of four or more being not a prime number), and the black ink recording head 5 has m nozzle openings Nb1 (m is a divisor of two or more, of N) arranged at the pitch Pb1 of P and nozzle openings Nb2 arranged at the pitch Pb3 of {N−(m−1)}P. Paper feed is executed in units of mP, whereby image data can be printed by the color ink recording head 6 at the dot density fitted for the image data and text data can be printed by the black ink recording head 5 at the dot density suitable for the text data at the same time.

In the embodiment described above, a case that text data and image data are mixed is described. However, it is apparent that only text data or only image data as a print data can be printed by the separate recording heads at respective resolutions.

In the embodiment-described above, paper feed corresponding to the print width H of the recording head is executed for each print path, but it is also possible to execute paper feed by microwave for printing.

Further, in the embodiment described above, the black ink recording head 5 and the color ink recording head 6 are made separate recording heads, but it is clear to provide a similar advantage if a single recording head is provided with a plurality of nozzle opening rows capable of separately ejecting different types of ink.

INDUSTRIAL APPLICABILITY

According to the invention, by executing paper feed fitted for the first recording head section including the nozzle openings arranged at large pitch, dots of the closely arranged nozzle openings of the second recording head section are formed so as to bridge a gap at a higher resolution than that of the color ink recording head. Therefore, image data can be printed at a lower resolution than text data without incurring lowering of the print speed in the same path as the text data.

The invention claimed is:

1. An ink jet recording apparatus, comprising:

a first recording head section, having nozzle openings arranged at a pitch Pc, in a paper feed direction, as NP (N is an integer of four or more being not a prime number) when pitch of dots required for print is P; and a second recording head section, having:

a plurality of sets of m nozzle openings (m is a divisor of two or more of N and m is not equal to N), the m nozzle openings of each set arranged at a pitch Pb1, in the paper feed direction, as P;

where the lowest of the m nozzle openings of each set is spaced at a pitch Pb3 from the uppermost of the m nozzle openings in a neighboring set, in the paper feed direction, as {N−(m−1)}P, wherein image data is printed by the first recording head section and text data is printed by the second recording head section in the same path while paper feed is executed in units of mP.

2. The ink jet recording apparatus as set forth in claim 1, wherein the second recording head section executes print in a period of 1/m of the first recording head section.

3. The ink jet recording apparatus as set forth in claim 1, wherein the second recording head section is divided into two sections and the first recording head section is provided between the two sections of the second recording head.

4. An ink jet recording apparatus comprising:

a first recording head section having respective nozzle openings arranged, in a paper feed direction, at a pitch Pc, where: Pc equals NP, N is an integer of four or more, and P is a pitch of dots required for printing; and a second recording head section having a plurality of sets of m nozzle openings, where the m nozzle openings of each set are arranged, in a paper feed direction, at a pitch Pb1, where Pb1 equals P, m is a divisor of two or more of N, and m is not equal to N, wherein a pitch between the lowest of the m nozzle openings in a set and the uppermost of the m nozzle openings in a neighboring set is Pb3, where Pb3 equals {N−(m−1)}P, and wherein image data is printed by the first recording head section and text data is printed by the second recording head section in the same path, while paper feed is executed in units of mP.

5. The ink jet recording apparatus as set forth in claim 4, wherein the second recording head section executes print in a period of 1/m of the first recording head section.

* * * * *